US005096542A

United States Patent [19]

Dove

[11] Patent Number: 5,096,542

[45] Date of Patent: Mar. 17, 1992

[54] SLICE LIP CONTROL MECHANISM

[75] Inventor: Norman F. Dove, North Vancouver, Canada

[73] Assignee: DeVron-Hercules Inc., North Vancouver, Canada

[21] Appl. No.: 221,919

[22] Filed: Jul. 20, 1988

[51] Int. Cl.[5] ..... D21C 1/02; D21C 1/06

[52] U.S. Cl. ..... 162/259; 162/263

[58] Field of Search ..... 73/768, 781; 162/259, 162/263, 252

[56] References Cited

U.S. PATENT DOCUMENTS 4,342,619 8/1982 Gladh ..... 162/259
4,726,883 2/1988 Shroeder ..... 162/259
4,773,272 9/1988 Trungold ..... 73/761

*Primary Examiner*—Steve Alvo
*Attorney, Agent, or Firm*—Christie, Parker & Hale

[57] ABSTRACT

A slice lip control mechanism for the slice lip of a head box of a paper making machine. The control mechanism has a linear actuator, a spindle extending from the actuator and a link on the lip to attach to the spindle. Movement of the actuator is thus transmitted to the lip, through the spindle, to deform the lip locally to control a head box outlet orifice whose upper edge is defined by the slice lip. The spindle includes a pressure transducer whereby the load applied to the lip by the actuator that communications with the pressure transducer through the spindle can be assessed and the lip's position calculated.

4 Claims, 1 Drawing Sheet

SLICE LIP CONTROL MECHANISM

FIELD OF THE INVENTION

This invention relates to a slice lip control mechanism.

DESCRIPTION OF THE PRIOR ART

In a paper making machine the furnish from the head box is fed onto the Fourdrinier wire through an orifice whose configuration can be controlled. Thus to control the distribution of the furnish in a cross machine direction means are provided to adjust the shape of the orifice. The orifice is a relatively narrow opening that extends across the width of the paper machine. The major components that make up the orifice comprise a bottom section, referred to as an apron, and a top section referred to as the slice lip. The slice lip can be manipulated to provide a means of adjustment of the orifice between the slice lip and the apron and thus provide means of local control.

To provide effective control it is desirable to know the position of the slice lip. One way of determining the position of the slice lip is to measure the position with an instrument such as a linear voltage displacement transmitter (LVDT). In this a movable element is attached to the slice lip. The element moves through a magnetic field in the LVDT and from this movement the position of the slice lip can be determined.

The disadvantage of such a system is that it must be closely coupled to the lip. If the device is too far from the lip it is possible to introduce error due to strain, bending of connecting elements and slippage between the lip and the coupling. However in many cases it is undesirable to locate the LVDT directly on the lip because of harshness of the environment in the paper mill and, of course, other physical restraints. A need therefore exists to provide a relatively inexpensive position feedback device that can be used to determine the actual position of the lip from a position remote from the lip.

The quality of the measurement of the lip position must be independent of any bending, strain or slippage that may take place within the mechanism that actually manipulates the lip.

One method of providing a measurement is to calculate accurately the position of the lip with regards to a known reference point. To be able to make such a calculation the following data are required:

1. The structural properties of the lip such as material and section modulus.
2. The method of supporting and loading the lip, for example the common arrangement of pin connections at six inch sections.
3. The applied loads at each connection.
4. The slice lip analysis equation.

All of the data relative to the lip itself are readily available by manufacturing a new lip or by measuring the existing lip. The reference point is a straight line; beam analysis equations are known and the lip may, of course, be treated as a beam. Thus if the loads applied to any given lip are known the exact shape of the lip can be computed.

SUMMARY OF THE INVENTION

The present invention seeks to provide a greatly simplified approach to determining the magnitude of the applied loads to a slice lip of a head box. Accordingly the present invention is in a slice lip control mechanism for the slice lip of the head box of a paper making machine comprising a linear actuator, a spindle extending from the actuator, a link on the lip to attach to the spindle whereby movement of the actuator is transmitted to the lip, through the spindle, to deform the lip locally to control a head box outlet orifice whose upper edge is defined by the slice lip and is the improvement whereby the spindle includes a pressure transducer whereby the load applied to the lip by the actuator that communicates with the pressure transducer through the spindle can be assessed and the lip's position thus calculated.

DESCRIPTION OF THE DRAWINGS

Aspects of the invention, and of the prior art, are illustrated in the accompanying drawings in which.

DESCRIPTION OF THE PREFERRED EMBODIMENTS

Figure 1:
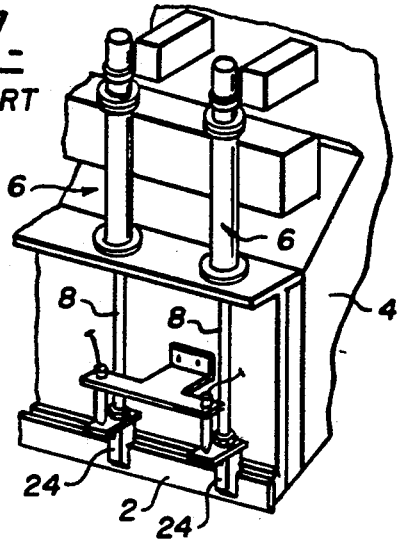
Fig. 1. PRIOR ART
FIG. 1 is a general view of a slice lip control mechanism according to the prior art.
Figure 2:
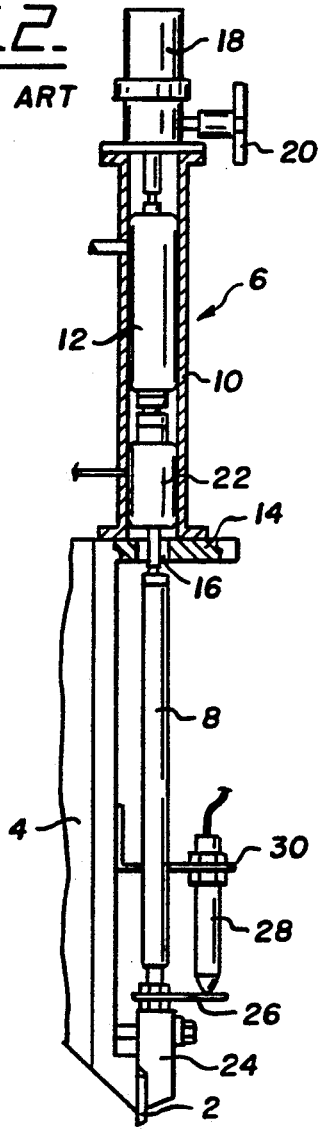
Fig. 2. PRIOR ART
FIG. 2 is a view, partially in section, of the prior art.

FIG. 1 shows a slice lip control mechanism for the slice lip 2 of the head box 4 of a paper making machine. The mechanism comprises a linear actuator 6 that may be of any known type. As shown somewhat schematically in FIG. 2 the actuator 6 is a thermal hydraulic unit in which heat is applied to an incompressible fluid to expand the fluid to apply downward pressure on spindle 8. A housing 10 holding the actuating mechanism 12 is mounted on a flange 14 and spindle 8 extends downwardly through opening 16 in the flange 14. The incompressible fluid is heated remotely and feed to the mechanism 12 may be controlled by a valve 18, the control for which is through handwheel 20. A force limiter 22 of known type is incorporated into the system. The actuating mechanism 12 moves spindle 8 which is attached to a link 24 that houses the slice lip 2. The link 24 is provided with a flange 26. A linear voltage displacement transmitter 28 is attached to a further flange 30, mounted to the head box 4. Thus movement of the flange 26 is the same as movement of the lip 2 and can be detected by the linear voltage displacement transmitter 28.

It should be emphasized that all the above is conventional in the art.

The disadvantages of the use of the linear voltage displacement transmitter 28 are clear. The drawings illustrate clearly that the LVDT 28 is mounted very close to the wire of the paper making machine (not shown but just below lip 2) that is in a relatively hostile environment for electrical components.

Figure 3:
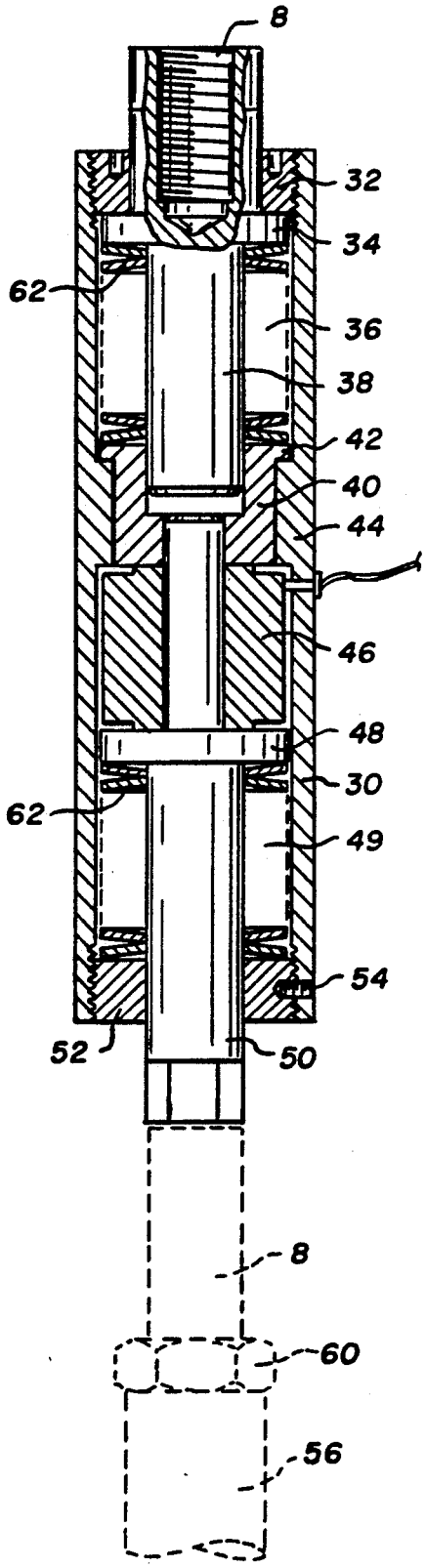
FIG. 3 illustrates the present invention.

The present invention, as illustrated in FIG. 3, makes the linear voltage displacement transmitter unnecessary. According to the invention the slice lip control mechanism includes a housing 30 attached to the spindle 8. The housing 30 has an upper threaded plug 32. The spindle 8 is threadedly attached to a piston 34 movable within chamber 36. A rod 38 extends from the piston 34 and is received within housing 40 formed with a flange 42 that abuts projection 44 formed within the housing 30. A load cell 46 is located within the housing 30 between projection 44 and a second piston 48 in chamber 49. Second piston 48 is connected to rod 50 which extends downwardly to abut the spindle 8. Rod 50 is located within the housing by lower threaded plug 52 threadedly received in housing 30 locked by grub screw 54. The spindle may be provided with a coupler 56 to permit varying the length of the spindle 8. A locknut 60 for the coupler is provided, such an arrangement is entirely conventional in spindles.

Within the chambers 36 and 49 are located Belleville washers 62. These washers 62 act to limit the force applied to the load cell 46.

The load cell is conventional. Its function is simply to determine the magnitude of the applied loads in the spindle 8.

In use of the load cell measures the change in force that is a direct function of the resistance created by deflecting the lip. Because of the presence of the force limiters 62 maximum force that can be exerted on the pressure transducer is limited. The measured force will be plus or minus the upper limit spring force determined by whether the applied force is compression or tension, that is push or pull.

The information obtained in conventional manner from the load cell is used to compute relative deflection to the slice lip. The information can be fed to a computer. That computer may contain a simple program in which constants for any one lip, the structural properties, the method of supporting and loading the lip and slice lip analysis equation as outlined above, are entered. The cell then provides the missing information concerning applied loads and, from the information, the position of the lip may be determined.

The data can also be used to determine when the condition of the slice lip is approaching a point where plastic deformation will occur. Such deformation must be avoided in slice lips. It is essential that any deformation of the lip used to control the orifice opening must be elastic, that is must remain below the elastic limits of the lip.

Load cells that have proved useful in the apparatus of the present invention include those with a rated capacity of one thousand to ten thousand pounds. A technical specification of such a load cell is as follows:

| | |
|---|---|
| Output Resistance: | 350 OHMS (nominal) 700 OHM BRG. 20,000. lb. |
| Input Resistance: | 350 OHMS (nominal) and larger |
| Excitation: | 10 VDC or AC |
| Sensitivity: | 2.M V/V at Capacity |
| Non-linearity: | +0.15% F.S. |
| Hysteresis: | +0.15% F.S. |
| Compensated Temp. Range: | 15° F.-150° F. |
| Safe Overload: | 150% Rated Capacity |
| Ultimate Overload: | 250% Rated Capacity |
| Zero Balance: | Better than 1% F.S. |

Load cells that have proved useful are those available under the trade mark ALD Load Cells available from AL Designs Inc.

I claim:

1. In a slice lip control mechanism for the slice lip of a head box of a paper making machine, the control mechanism comprising at least one linear actuator, a spindle downwardly extending from the at least one actuator, a link on the lip to attach to the spindle wherein the at least one actuator is in a housing remote from the lip and the movement of the actuator is transmitted to the lip, through the spindle, to deform the lip locally to control a head box outlet orifice whose upper edge is defined by the slice lip, wherein the improvement comprises providing a further housing and locating the pressure transducer in the further housing below the at least one linear actuator and the pressure transducer is in communication with a computer wherein the load applied to the lip by the actuator that communicates with the pressure transducer through the spindle can be assessed by the computer and the lip's position thus calculated by the computer.

2. A mechanism as claimed in claim 1 in which the pressure transducer is a load cell.

3. A mechanism as claimed in claim 1 further comprising force limiters disposed in the further housing to limit the force applied to the pressure transducer.

4. A mechanism as claimed in claim 3 in which the force limiters comprise springs on each side of the pressure transducer.

* * * * *